US008251329B2

(12) United States Patent
Suciu et al.

(10) Patent No.: US 8,251,329 B2
(45) Date of Patent: Aug. 28, 2012

(54) CAM HOLDER SYSTEM

(75) Inventors: Rebecca C. Suciu, Lynn, MA (US); David E. Pitcher, Swampscott, MA (US); Thomas P. Burrous, Haverhill, MA (US); Alan L. Stenfors, Scituate, MA (US); Sidney Rose, Marblehead, MA (US)

(73) Assignee: Rose Displaya Ltd, Salem, MA (US)

( * ) Notice: Subject to any disclaimer, the term of this patent is extended or adjusted under 35 U.S.C. 154(b) by 380 days.

(21) Appl. No.: 12/649,950

(22) Filed: Dec. 30, 2009

(65) Prior Publication Data

US 2011/0155883 A1 Jun. 30, 2011

(51) Int. Cl.
*A47G 1/10* (2006.01)

(52) U.S. Cl. ..... 248/316.2; 40/611.12

(58) Field of Classification Search ..... 248/316.2, 248/316.5, 316.7, 313, 689, 201; 40/658, 40/611.12

See application file for complete search history.

(56) References Cited

U.S. PATENT DOCUMENTS

| | | | | |
|---|---|---|---|---|
| 3,354,564 | A * | 11/1967 | Falcone et al. | 40/658 |
| 3,891,093 | A | 6/1975 | Petrie | |
| 4,836,389 | A | 6/1989 | Poulton | |
| 5,608,980 | A | 3/1997 | Pangerl | |
| 5,711,430 | A | 1/1998 | Andersen et al. | |
| 5,863,019 | A | 1/1999 | Rose et al. | |
| 5,927,671 | A | 7/1999 | Pynenburg | |
| 6,088,942 | A | 7/2000 | Brooks et al. | |
| 6,149,117 | A | 11/2000 | Shao | |
| 6,546,658 | B2 | 4/2003 | Pitcher et al. | |
| 6,637,716 | B2 | 10/2003 | Wear | |
| 6,793,185 | B2 * | 9/2004 | Joliey | 248/220.21 |
| 6,862,780 | B2 | 3/2005 | Henry | |
| 7,086,190 | B2 * | 8/2006 | Voluckas | 40/617 |
| 2005/0097800 | A1 * | 5/2005 | Pitcher et al. | 40/658 |

FOREIGN PATENT DOCUMENTS

| | | |
|---|---|---|
| DE | 43 41 741 A1 | 6/1995 |
| GB | 2 222 630 A | 3/1990 |

OTHER PUBLICATIONS

Accenta; http://www.accenta.com/index.php?/products/overview/exstream/.
Marc Bric; http://www.markbricdisplay.com/.
Big Poster Company (based in U.K.); http://www.bigpostercompany.co.uk/frame_data.php?id=18.

* cited by examiner

*Primary Examiner* — Ramon Ramirez
(74) *Attorney, Agent, or Firm* — Nixon Peabody, LLP; Jeffrey L. Costellia

(57) ABSTRACT

A cam holder system is described. A cam mechanism allows the holder to accept sheet material and be closed easily, while still maintaining strong holding power. The holder is formed by two or more separate pieces of extruded rigid material that slide together. End caps can be used to hold the pieces in alignment with each other so that they do not slide apart when the holder is opened. The cam is located near the middle of the assembly so that the user has leverage when opening and closing the holder. The holder can be squeezed in one direction to open the holder, and in the other direction to close the holder. A lever arm for closure is located above the cam, and a lever arm for opening is located below the cam. The receiving slot is located on-center so that the holder and the sheet material remain aligned with each other during use.

13 Claims, 5 Drawing Sheets

CAM HOLDER SYSTEM

BACKGROUND OF THE INVENTION

1. Field of the Invention

The present invention relates to a cam holder system. More particularly, the present invention relates to a cam holder system for clasping sheet material.

2. Description of Related Art

In general, display holders are used for suspending replaceable sheet material, such as posters, pictures, signs, and advertisements. They are traditionally placed in public areas, such as storefronts, buses, taxicabs, stands, and the like. In retail locations, signs are hung in windows or inside the store to draw customers and passersby into the store, and/or to advertise a special item or promotion. These retail locations may be standalone big box stores or specialty shops, or may be located within shopping or strip malls. Display holders may also used in private areas, such as offices and homes, for displays, presentations, or decorations.

Traditional devices for gripping and suspending sheet material are either suspended from the ceiling or affixed to a wall. The devices are designed to receive and engage the material easily, while bearing the weight of the suspension. However, many traditional devices fail to adequately meet this objective.

One traditional suspension device uses a two-piece aluminum construction. The two rails come together on the side, forming a gap that is used to insert the sheet material. The holder is easy to close, but requires a tool to open. A more recent system allows the two halves of the holder to come together at the top of the holder so that the user can pry it open by hand. However, the halves are very close together, making opening difficult. Other holders have hinged clips with limited ranges of motion, while still others use basic clips that are sometimes unable to support the weight of the sheet material.

SUMMARY OF THE INVENTION

Thus, there is a need in the art for a system for clasping sheet material that is designed to readily and easily receive and engage sheet material such that the sheet material can be changed as frequently as desired. Furthermore, there is a need in the art for a system that provides sufficient clamping engagement to support the weight of the sheet material.

A cam holder system is described that meets these and other needs. A cam mechanism allows the holder to accept sheet material and be closed easily, while still maintaining strong holding power. The holder is formed by two or more separate pieces of rigid material that slide together. The material may be extruded aluminum, stainless steel, plastic, and the like. The surface of these outer pieces can be any shape. In one embodiment, the pieces have a concave curve shape that assists in opening and closing the cam holder by hand. The pieces may be shaped to create a funnel-shaped slot when the two halves are in an open position, allowing for easy introduction of sheet material into the receiving slot. End caps can be used to hold the pieces in alignment with each other so that they do not slide apart when the holder is opened.

Sheet material may be any material capable of being clasped, such as, for example, posters, pictures, signs, and advertisements, made of a wide variety of stock, such as paper, metal, plastic, rubber, glass, etc. The stock may be coated, laminated, or plain, and may be flexible or rigid. Furthermore, the stock may be soft or hard, and have a high or low coefficient of friction.

The cam is located near the middle of the assembly so that the user has leverage when opening and closing the holder. The outer pieces can be squeezed in one direction to open the holder, and squeezed in the other direction to close the holder. A lever arm frame member for closure is located above the cam, and a lever arm for opening the holder is located below the cam. The receiving slot is located on-center so that the cam holder system hangs straight in alignment with the received sheet material.

In one embodiment, a cam holder system for clasping sheet materials between a pair of cam surfaces is provided that comprises: a first elongated frame member having a first cam surface defined thereon; a second elongated frame member having a second cam surface defined thereon; a hinge element coupled to the first elongated frame member and the second elongated frame member to pivotally attach the first elongated frame member to the second elongated frame member with the first cam surface and the second cam surface opposing one another and to define an axis of rotation substantially in the longitudinal center of the first elongated frame member and the second elongated frame member about which the first elongated frame member and the second elongated frame member rotate relatively; wherein the first cam surface and the second cam surface are on the same side of the axis of rotation in a latitudinal direction of the first elongated frame member and the second elongated frame member to allow the first cam surface to move relatively toward the second cam surface when the first elongated frame member and the second elongated frame member rotate relatively about the axis of rotation.

In one example, the first elongated frame member includes a first leg and a second leg and the hinge element is coupled to the first elongated frame member by the first leg. In another example, the second elongated frame member includes an outer closing arm positioned substantially above the longitudinal center, an outer opening arm positioned substantially below the longitudinal center, and an inner arm, and wherein the hinge element is coupled to the second elongated frame member by the inner arm.

In another example, the outer closing arm of the second elongated frame member rotates about the axis of rotation toward the first elongated frame member to move the second cam surface toward the first cam surface to clasp sheet material. In this example, the first earn surface and the second cam surface may further oppose one another substantially in the longitudinal center of the first elongated frame member and the second elongated frame member when the outer closing arm of the second elongated frame member is rotated about the axis of rotation toward the first elongated frame member.

In another example, the inner opening arm of the second elongated frame member rotates about the axis of rotation toward the first elongated frame member to move the second cam surface away from the first cam surface to un-clasp sheet material. In still another example, the first elongated frame member and the second elongated frame member form a receiving slot to receive the sheet material. In a further example, the hinge element is a rod and channel element. In another example, at least one of the first elongated frame member and the second elongated frame member comprise extruded aluminum.

In one example, the first elongated frame member includes an end cap leg. In that same example, the first elongated frame member and the end cap leg may further form an end cap channel configured to engage one or more end caps.

In another example, the cam holder system further comprises an end cap.

In still another example, at least one of the first elongated frame member and the second elongated frame member includes a clip channel. In that same example, the clip channel may further be configured to engage one or more clips.

Still other aspects, features and advantages of the present invention are readily apparent from the following detailed description, simply by illustrating a number of exemplary embodiments and implementations, including the best mode contemplated for carrying out the present invention. The present invention also is capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

A cam holder system for clasping sheet material is described. In the following description, for purposes of explanation, numerous specific details are set forth in order to provide a thorough understanding of the exemplary embodiments. It is apparent to one skilled in the art, however, that the present invention can be practiced without these specific details or with an equivalent arrangement.

Figures 1A, 1B:
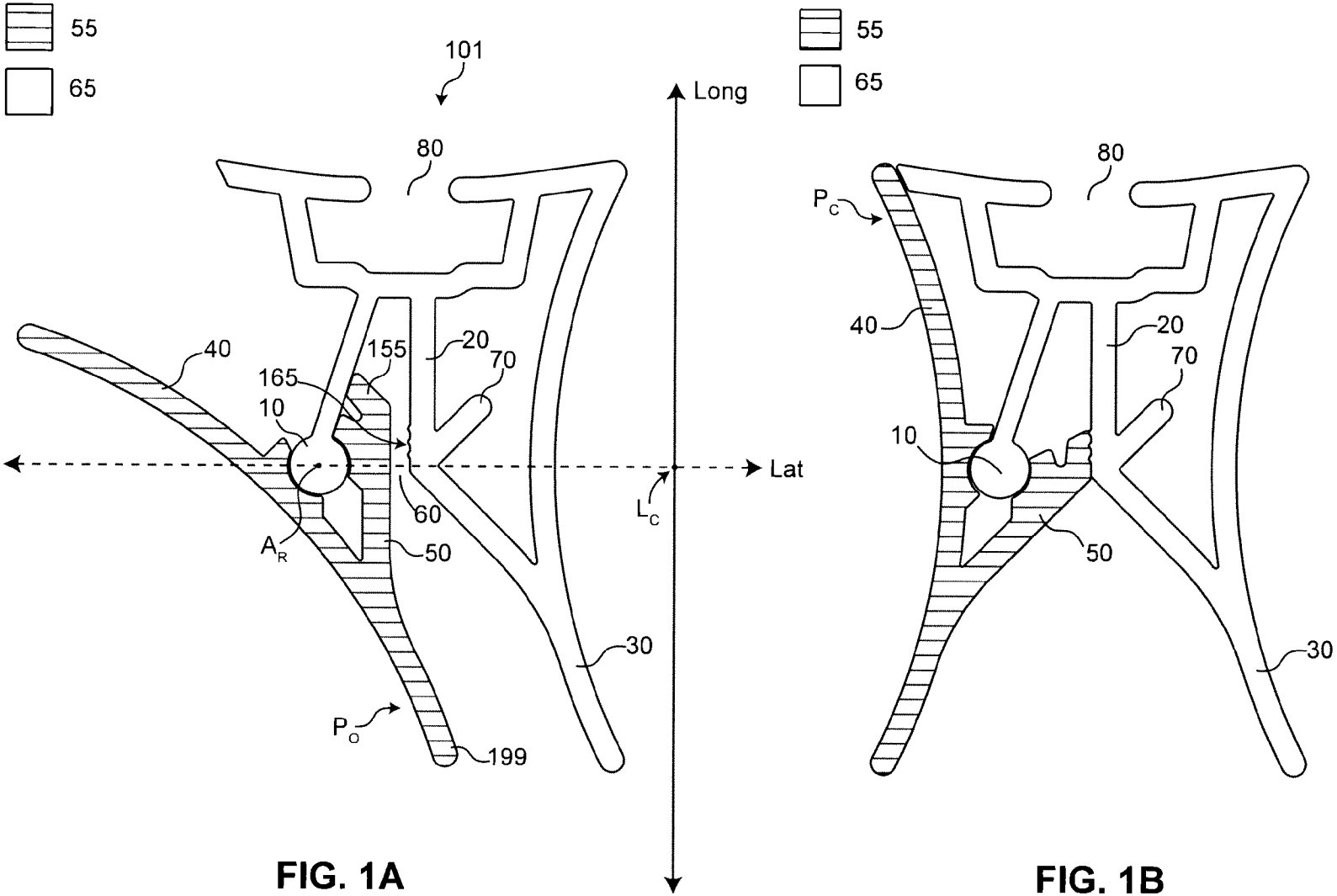
FIG. 1A is an end view of a cam holder system in an open position according to an embodiment of the present invention.
FIG. 1B is an end view of a cam holder system in a closed position according to an embodiment of the present invention.

Referring now to the drawings, wherein like reference numerals designate identical or corresponding parts throughout the several views, FIGS. 1A and 1B show an end view of a cam holder system according to an embodiment of the present invention in an open and closed position, respectively. Cam holder system 101 is formed by two pieces that slide together, a first elongated frame member 65 and a second elongated frame member 55, made of a rigid material. The rigid material may be extruded aluminum, stainless steel, plastic, and the like.

First elongated frame member 65 includes hinge element 10, which is shown as circular in shape, but may also be any other rotatable shape. First elongated frame member 65 also includes elongated handle 30 and inner wall 20. In one embodiment, first elongated frame member 65 also has angled leg 70, which can be configured to engage one or more end caps (not shown) that can be used to hold first elongated frame member 65 and second elongated frame member 55 in alignment with each other so that they do not slide apart when holder system 101 is opened.

Second elongated frame member 55 of cam holder system 101 has outer arm 40 and inner arm 50. Inner arm 50 has second cam surface 155. A gap is formed between outer arm 40 and inner arm 50, which pivotally houses hinge element 10 of first elongated frame member 65. Hinge element 10 is shown as a rod and channel configuration, but it is contemplated that it can be any other connectable configuration, such as a pivot joint, a glide joint, a hinge, and the like.

Elongated handle 30 and outer arm 40 extend both above and below the axis of rotation $A_R$, which is located substantially in the longitudinal center of the first elongated frame member 65 and the second elongated frame member 55, near the middle of cam holder system 101 so that a user has substantially equal leverage when both opening and closing system 101.

In one embodiment, cam holder system 101 has been opened, as shown in FIG. 1A, by applying lateral opening pressure $P_o$ on outer arm 40 below longitudinal center $L_C$, of the second elongated frame member 55. The applied lateral opening pressure $P_o$ causes second elongated frame member 55 to rotate about the axis of rotation $A_R$, and move second cam surface 155 away from first cam surface 165.

The cam holder system 101 has been closed, as shown in FIG. 1B, by applying lateral closing pressure $P_c$ on outer arm 40 above longitudinal center $L_C$ of the second elongated frame member 55. The applied lateral closing pressure $P_c$ causes second elongated frame member 55 to rotate about the axis of rotation $A_R$, and move second cam surface 155 toward first cam surface 165, to clasp sheet material between first cam surface 165 and second cam surface 155.

As shown in FIG. 1A, when cam holder system 101 is in an open position, receiving slot 60 is created between inner arm 50 and inner wall 20. As shown in FIG. 1B, when the cam holder system 101 is closed, the distal end of outer arm 40 located below the axis of rotation $A_R$ is pushed toward first elongated frame member 65 and receiving slot 60 no longer exists, as second cam surface 155 rotates directly opposing first cam surface 165.

First cam surface 165 and second cam surface 155 are on the same side of the axis of rotation $A_R$ in a latitudinal direction Lat of first elongated frame member 65 and second elongated frame member 55. This allows second cam surface 155 to move relatively toward first cam surface 165 when first elongated frame member 65 and second elongated frame member 55 rotate relatively about the axis of rotation $A_R$. Similarly, if the opening and closing lateral pressures were applied to first elongated frame member 65 instead of to second elongated frame member 55, then first elongated frame member 65 would rotate toward and away from second elongated frame member 55. In that example, first cam surface 165 would move relatively toward and away, respectively, from second cam surface 155.

Receiving slot 60 is located on-center of system 101 so that cam holder system 101 hangs straight in alignment with the clasped sheet material. In one example, in order to increase holding strength of cam holder system 101, first cam surface 165 and/or second cam surface 155 may be grooved, scored, coated, scratched, or otherwise altered to increase the friction between inserted sheet material and first cam surface 165 and/or second cam surface 155.

Figure 5:
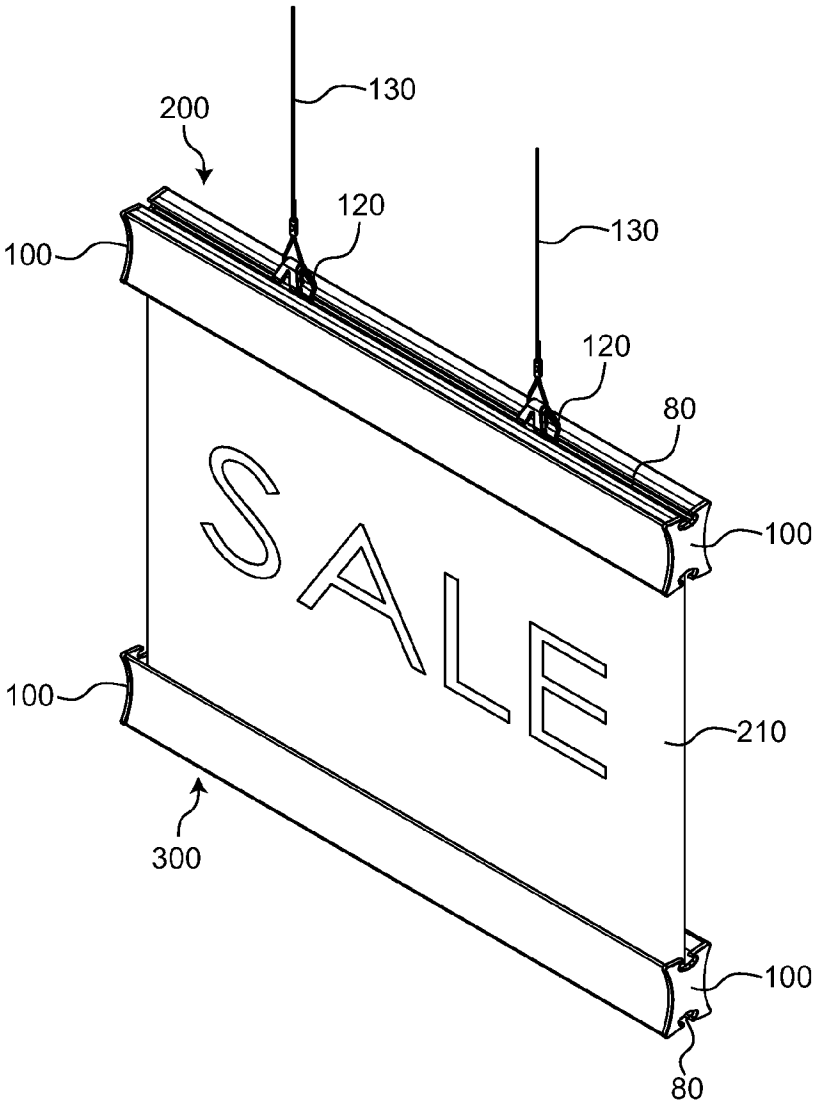
FIG. 5 is a perspective view of two cam holder systems clasping sheet material according to an embodiment of the present invention.

Hinge element 10 is coupled to second elongated frame member 55 by inner arm 50. In one embodiment, clip channel 80 is also coupled to first elongated frame member 65. Clip channel 80 is configured to engage one or more clips for hanging the cam holder system 101, as shown in FIG. 5 and described herein. Clip channel 80 is shown as trapezoidal in shape, but may also be any other shape, including circular or rectangular.

Elongated handle 30 and outer arm 40 may be positioned such that a funnel shape is created between them when cam holder system 101 is in an open position of FIG. 1A, allowing for easy introduction of sheet material into receiving slot 60. In this embodiment, elongated handle 30 and outer arm 40 are of a mirrored concave curve shape to assist in opening and closing cam holder system 101 comfortably and easily by hand. However, elongated handle 30 and outer arm 40 may be of any shape, and do not necessarily have to be of the same or mirrored shape, and do not necessarily have to create a funnel between them.

Figure 2B:
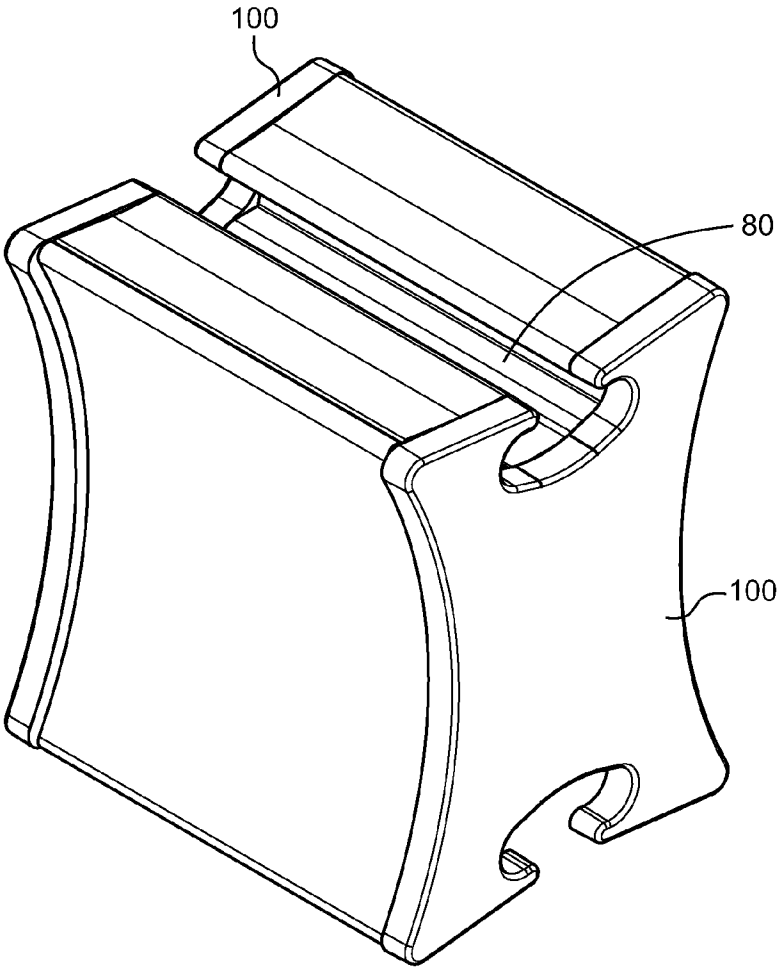
FIG. 2B is a perspective view of a cam holder system with end caps according to an embodiment of the present invention.
Figure 2A:
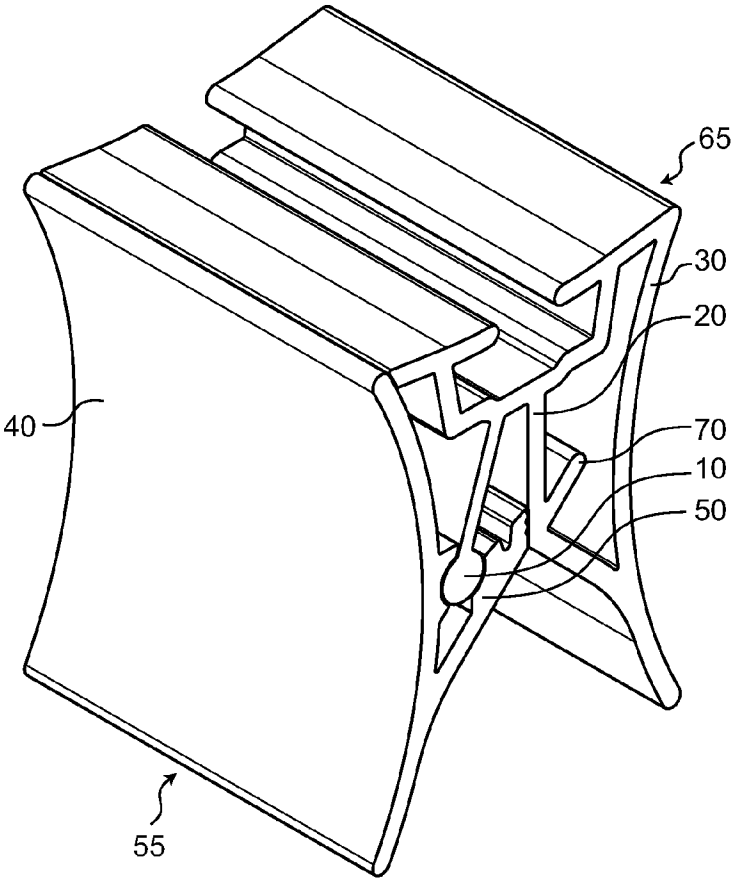
FIG. 2A is a perspective view of a cam holder system according to an embodiment of the present invention.

FIGS. 2A and 2B are three-dimensional perspective views of cam holder system 101 according to an embodiment of the present invention, without and with an end cap, respectively. As described previously, the first elongated frame member 65 and the second elongated frame member 55 are pivotally connected via hinge element 10. In order to ensure that second elongated frame member 55 and first elongated frame member 65 do not disconnect by sliding apart, end caps 100 may be removably or permanently affixed on either end of cam holder system 101, as shown in FIG. 2B. End caps 100 are configured to be slid into cam holder system 101 between elongated handle 30 and angled leg 70. In this instance, end caps 100 have an elongated triangular insertion leg (not shown) that slides into the triangular channel formed between elongated handle 30 and angled leg 70. Angled leg 70 extends along the entire length of cam holder system 101 in order to accommodate a plurality of lengths of the insertion leg of end caps 100. In this example, end caps 100 are shaped to accommodate clip channel 80, so that clip channel 80 may be accessed even after end caps 100 have been affixed.

Figure 3C:
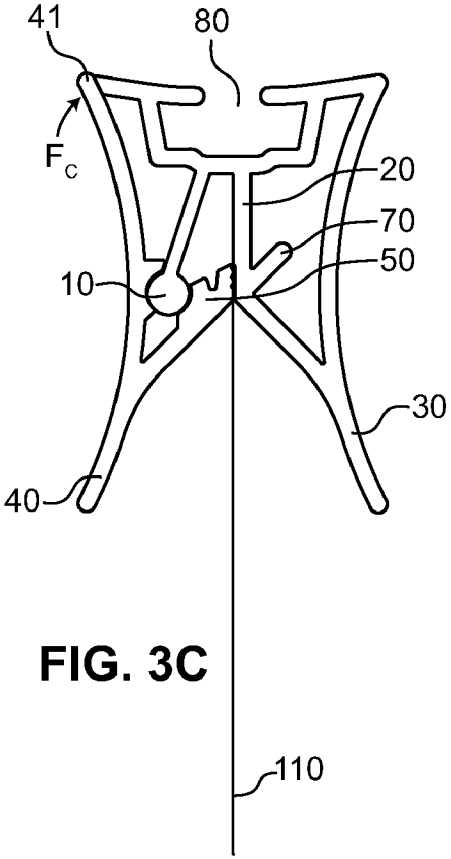
FIG. 3C is an end view of a cam holder system in a closed position with sheet material positioned within the receiving slot according to an embodiment of the present invention.
Figure 3B:
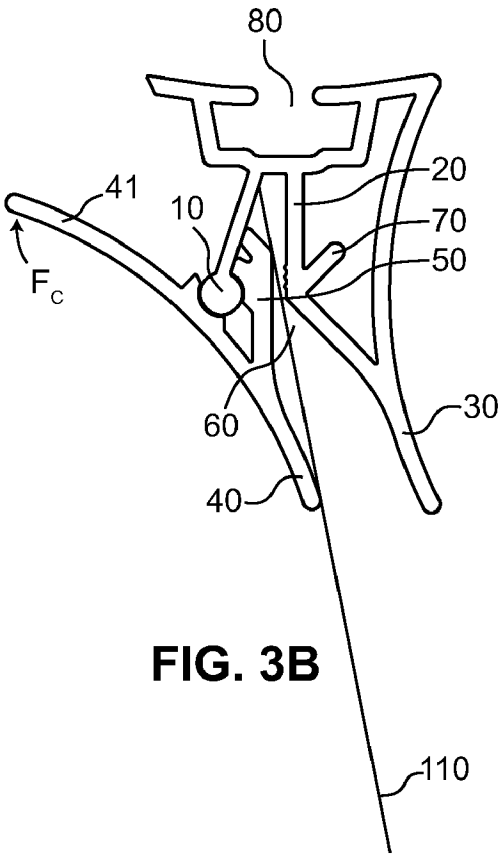
FIG. 3B is an end view of a cam holder system in an open position with sheet material positioned within the receiving slot according to an embodiment of the present invention.
Figure 3A:
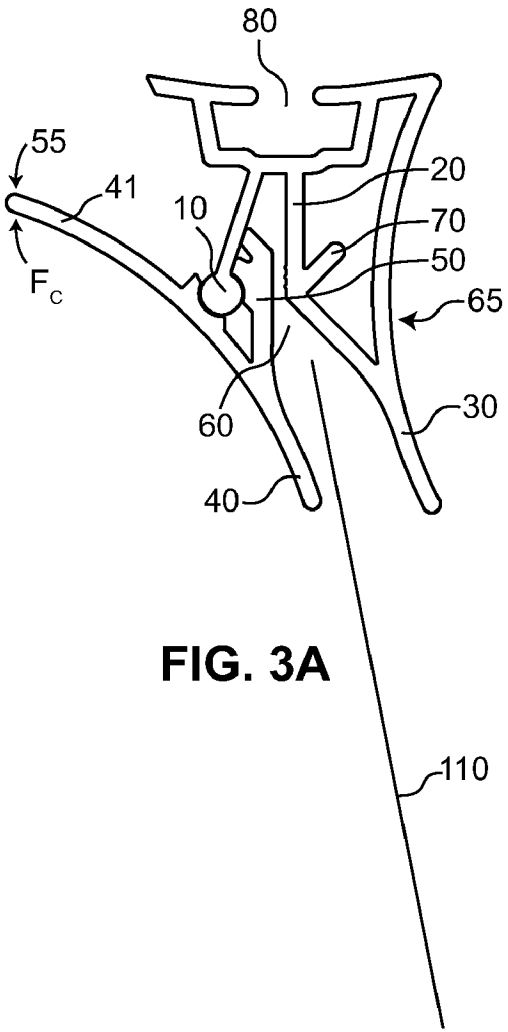
FIG. 3A is an end view of a cam holder system in an open position with sheet material positioned between the frame member and the lever arm member according to an embodiment of the present invention.

FIGS. 3A-3C illustrate a step-by-step end view as sheet material 110 is being inserted into the cam holder system 101 between the first elongated frame member 65 and the second elongated frame member 55. In FIG. 3A, the cam holder system 101 is in an open position with sheet material 110 approaching receiving slot 60. As discussed previously, cam holder system 101 has been opened by applying pressure on a proximal end of outer arm 40 below hinge element 10, and causing the lever arm member to pivot open.

In FIG. 3B, sheet material 110 is positioned within receiving slot 60. Finally, in FIG. 3C, cam holder system 101 has been closed by applying force $F_C$ on the distal end 41 of outer arm 40 above hinge element 10 in the direction indicated, and causing the lever arm member to pivot closed. Inner arm 50 is positioned directly against sheet material 110, which is positioned directly against inner wall 20. As discussed previously, receiving slot 60 is located on-center so that the cam holder system 101 hangs straight in alignment with the clasped sheet material 110.

Figure 4B:
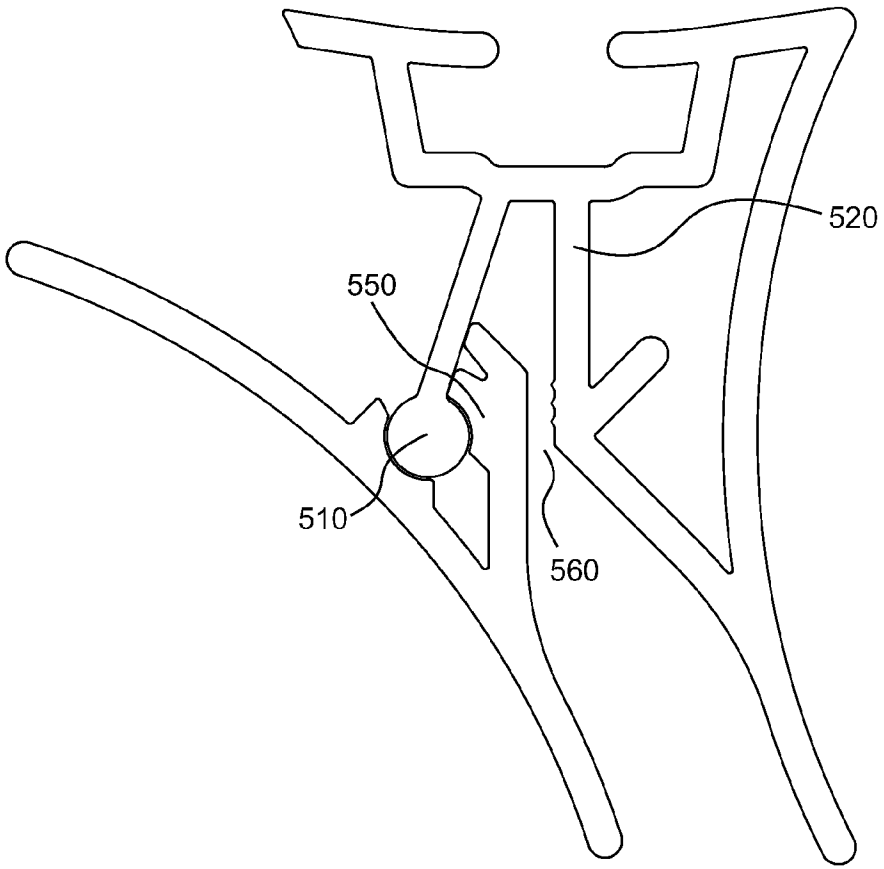
FIG. 4B is an end view of a cam holder system with wide grip in an open position according to an embodiment of the present invention.
Figure 4A:
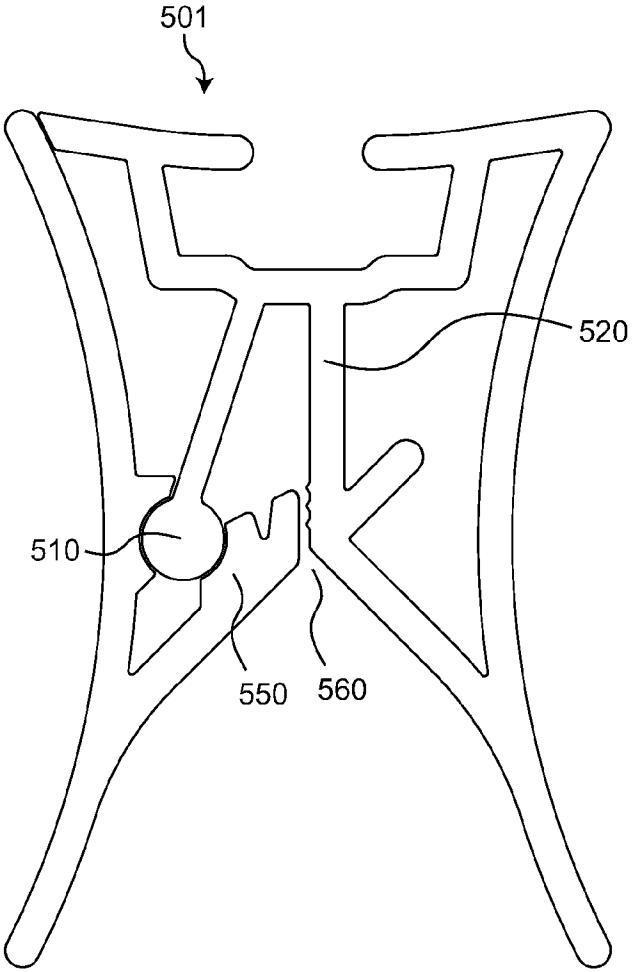
FIG. 4A is an end view of a cam holder system with wide grip in a closed position according to an embodiment of the present invention.

FIGS. 4A and 4B show an end view of a cam holder system 501 with wide grip according to an embodiment of the present invention in a closed and open position, respectively. In this embodiment, hinge element 510 is positioned further from inner wall 520 in order to create wide receiving slot 560. Wide receiving slot 560 is positioned between inner wall 520 and inner arm 550 regardless of whether the cam holder system 501 is in an open or closed position. This embodiment allows the system 501 to accommodate larger, thicker, and/or softer sheet material without puncturing, perforating, flattening, or otherwise damaging the sheet material between inner wall 520 and inner arm 550 when the system 501 is in a closed position (FIG. 4A).

FIG. 5 is a perspective view of cam holder systems 200 and 300 attached to sign 210. Sign 210 is positioned between the inner wall and inner wall of cam holder systems 200 and 300 on both ends, and was inserted into systems 200 and 300 by the method illustrated in FIGS. 3A-C. Cam holder system 200 has clips 120 attached via clip channel 80, and cords 130 attached to clips 120 by which to suspend the system. In this embodiment, clips 120 are slid into an end of clip channel 80 and moved parallel within the channel until they reach desirable positions. Clips 120 may also be positioned into clip channel 80 by squeezing the clips and applying pressure to them perpendicularly to clip channel 80 until they are positioned within the channel. In another embodiment, clips 120 may be permanently affixed to clip channel 80.

Although clip channel 80 of cam holder system 300 does not have clips 120, it is possible for clip channel 80 to have clips 120 and cords 130 that attach cam holder system 300 to another cam holder system and sign via another set of clips, and so forth.

Cam holder systems 200 and 300 have end pieces 100 positioned at both ends of each system. As discussed previously, end pieces 100 may be removably or permanently affixed on either or both ends of cam holder systems 200 and 300 in order to ensure that the systems do not disconnect by sliding apart.

Other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

What is claimed is:

1. A cam holder system for clasping sheet material between a pair of cam surfaces, said system comprising:

a first elongated frame member having a first cam surface defined thereon;

a second elongated frame member having a second cam surface defined thereon and including an an outer arm and an inner arm, said outer arm including a first portion positioned substantially above a longitudinal center of the second elongated frame member and a second portion positioned substantially below the longitudinal center of the second elongated frame member;

a hinge element coupled to said first elongated frame member and said second elongated frame member to pivotally attach said first elongated frame member to said second elongated frame member with said first cam surface and said second cam surface opposing one another and to define an axis of rotation substantially in the longitudinal center of said first elongated frame member and said second elongated frame member about which said first elongated frame member and said second elongated frame member rotate relatively, wherein the hinge element is pivotally attached to said second elongated frame member between the inner arm and the outer arm of said second elongated frame member;

wherein said first cam surface and said second cam surface are on the same side of the axis of rotation in a latitudinal direction of said first elongated frame member and said second elongated frame member to allow said first cam surface to move relatively toward said second cam surface when said first elongated frame member and said second elongated frame member rotate relatively about the axis of rotation.

2. The cam holder system of claim 1, wherein the first portion of the outer arm of said second elongated frame member rotates about the axis of rotation toward said first elongated frame member to move said second cam surface toward said first cam surface.

3. The cam holder system of claim 2, wherein the first cam surface and the second cam surface oppose one another substantially in the longitudinal center of said first elongated frame member and said second elongated frame member when the first portion of the outer arm of said second elongated frame member is rotated about the axis of rotation toward said first elongated frame member.

4. The cam holder system of claim 1, wherein the second portion of the outer arm of said second elongated frame member rotates about the axis of rotation toward said first elongated frame member to move said second cam surface away from said first cam surface.

5. The cam holder system of claim 1, wherein the first elongated frame member and the second elongated frame member form a receiving slot.

6. The cam holder system of claim 1, wherein the hinge element is a rod and channel element.

7. The cam holder system of claim 1, wherein at least one of the first elongated frame member and the second elongated frame member comprise extruded aluminum.

8. The cam holder system of claim 1, wherein the first elongated frame member includes an angled leg.

9. The cam holder system of claim 8, wherein an elongated handle of the first elongated frame member and the angled leg form a channel configured to engage one or more end caps.

10. The cam holder system of claim 1 further comprising: one or more end caps.

11. The cam holder system of claim 10, wherein at least one of the one or more end caps has one or more openings for accessing one or more clip channels.

12. The cam holder system of claim 1, wherein at least one of the first elongated frame member and the second elongated frame member includes a clip channel.

13. The cam holder system of claim 12, wherein the clip channel is configured to engage one or more clips.

* * * * *

UNITED STATES PATENT AND TRADEMARK OFFICE

CERTIFICATE OF CORRECTION

PATENT NO. : 8,251,329 B2
APPLICATION NO. : 12/649950
DATED : August 28, 2012
INVENTOR(S) : Rebecca C. Suciu et al.

It is certified that error appears in the above-identified patent and that said Letters Patent is hereby corrected as shown below:

Title page at Item (73) Assignee: delete "Rose Displaya Ltd, Salem, MA (US)" and insert --Rose Displays Ltd., Salem, MA (US)-- in its place.

Signed and Sealed this
Twenty-first Day of May, 2013

Teresa Stanek Rea
*Acting Director of the United States Patent and Trademark Office*